US005370961A

United States Patent [19]

Zaretsky et al.

[11] Patent Number: 5,370,961

[45] Date of Patent: Dec. 6, 1994

[54] METHOD OF ELECTROSTATIC TRANSFERRING VERY SMALL DRY TONER PARTICLES USING AN INTERMEDIATE

[75] Inventors: Mark C. Zaretsky; Earl G. Gomes, both of Rochester, N.Y.

[73] Assignee: Eastman Kodak Company, Rochester, N.Y.

[21] Appl. No.: 984,653

[22] Filed: Dec. 2, 1992

[51] Int. Cl.[5] ..... G03G 13/16

[52] U.S. Cl. ..... 430/126; 355/271

[58] Field of Search ..... 430/109, 111, 126; 355/271

[56] References Cited

U.S. PATENT DOCUMENTS

| | | | |
|---|---|---|---|
| 3,697,171 | 10/1972 | Sullivan | 355/17 |
| 3,811,765 | 5/1974 | Blake | 355/3 R |
| 3,893,761 | 7/1975 | Buchan et al. | 355/3 R |
| 3,923,392 | 12/1975 | Buchan et al. | 355/3 R |
| 4,068,937 | 1/1978 | Willemse et al. | 355/3 TR |
| 4,301,228 | 11/1981 | Kori et al. | 430/122 |
| 4,430,412 | 2/1984 | Miwa et al. | 430/126 |
| 4,453,820 | 6/1984 | Suzuki | 355/3 TR |
| 4,455,079 | 6/1984 | Miwa et al. | 355/3 TR |
| 4,513,074 | 4/1985 | Nash et al. | 430/106.6 |
| 4,531,825 | 7/1985 | Miwa et al. | 355/3 TR |
| 4,623,604 | 11/1986 | Takagiwa et al. | 430/109 |
| 4,702,959 | 10/1987 | Shimozawa et al. | 428/323 |
| 4,737,433 | 4/1988 | Rimai et al. | 430/111 |
| 4,797,339 | 1/1989 | Maruyama et al. | 430/109 |
| 4,803,144 | 2/1989 | Hosoi | 430/106.6 |
| 4,869,982 | 9/1989 | Murphy | 430/48 |
| 4,899,196 | 2/1990 | Mahoney | 355/271 |
| 4,950,573 | 8/1990 | Yamaguchi et al. | 430/109 |
| 4,984,026 | 1/1991 | Nishise et al. | 355/277 |
| 4,985,327 | 1/1991 | Sakashita et al. | 430/106.6 |
| 4,990,647 | 2/1991 | Himmler et al. | 558/414 |
| 5,027,158 | 6/1991 | Tompkins et al. | 355/271 |
| 5,084,735 | 1/1992 | Rimai et al. | 355/271 |
| 5,089,363 | 2/1992 | Rimai et al. | 430/97 |

FOREIGN PATENT DOCUMENTS

| | | | |
|---|---|---|---|
| 54-051844 | of 1979 | Japan | G03G 9/08 |
| 62-237463 | of 1987 | Japan | G03G 9/08 |
| 63-256969 | of 1988 | Japan | G03G 9/08 |
| 01237561 | of 1989 | Japan | G03G 9/08 |
| 2166881-A | 5/1985 | United Kingdom | G03G 9/08 |

OTHER PUBLICATIONS

U.S. Patent Application Ser. Nos. 07/843,587, 07/843,666 and 07/843,664, filed Feb. 28, 1992.

J. Appl. Phys. 66, 3574–3578 (1989) by D. S. Rimai and L. P. DeMejo and R. C. Bowen.

Xerography and Related Processes, p. 393, Focal Press (N.Y.) by John H. Dessauer and Harold E. Clark.

Polym. Sci. Technol. 9B, pp. 763–827 (1975) by N. S. Goel and P. R. Spencer.

*Primary Examiner*—John Goodrow

*Attorney, Agent, or Firm*—Robert Luke Walker

[57] ABSTRACT

A toner particle image made up of toner particles having a mean particle diameter of less than 7 microns and transfer-assisting particles strongly adhering to the surfaces of the toner particles having a mean particle diameter between about 0.01 microns and about 0.2 microns is electrostatically transferred to an intermediate. An intermediate has a base having a Youngs modulus of $10^7$ Newtons/$m^2$ or less and a thin overcoat or skin which has a Youngs modulus of $5\times10^7$ Newtons/$m^2$ or more. The toner image is then electrostatically transferred from the intermediate image member to a receiving sheet. The surface of the intermediate image member receiving the toner image preferably has a roughness average equal to 20% of the mean diameter of the toner particles or less.

12 Claims, 1 Drawing Sheet

METHOD OF ELECTROSTATIC TRANSFERRING VERY SMALL DRY TONER PARTICLES USING AN INTERMEDIATE

FIELD OF THE INVENTION

This invention relates to the transfer of electrostatically formed toner images of very small, dry toner particles, for example, particles having a mean particle diameter less than 7 microns and, especially, less than 5 microns in diameter.

BACKGROUND ART

The transfer of very small, dry toner particles from a photoconductor or other image member to a receiving sheet is extremely challenging. Conventional dry toner transfer is accomplished using an electrostatic field. However, studies on the forces which move small particles indicate that, as the particle becomes smaller, the effect of the electrostatic field is less on a particle compared to the effect of ordinary adhesive forces. This has made conventional transfer using an electrostatic field more difficult the smaller the particle.

Because it has been considered not possible to electrostatically transfer particles as small as 3.5 microns in diameter with reasonable efficiency, other transfer means have been investigated. For example, particles as small as 3.5 microns in diameter are transferred by heating them to a temperature which causes them to sinter at least where they touch the surface to which they are to be transferred and to each other; see, for example, U.S. Pat. No. 5,089,363, Rimai et al.

The use of intermediates in electrostatic imaging has also been known for many years and has been used commercially in recent years. Typically, the toner image is formed on a primary image member, for example, a photoconductive member. The image is transferred from the primary image member to an intermediate image member and then from the intermediate to a receiving sheet. Although this approach has some advantages in single-color imaging, it has its greatest advantages in multicolor imaging where the intermediate can be used to receive a number of single-color images in registration to form the multicolor image.

U.S. Pat. No. 5,084,735 discloses the use of particular materials which enhance intermediate transfer of dry toner images made up of particles having a mean particle size of less than 15 microns, including examples in which toners having a mean particle size of 7 microns were effectively transferred to 20 pound bond paper. Especially spectacular results were achieved with an intermediate roller having a relatively soft polyurethane base having a Youngs modulus of about $10^6$ Newtons/$m^2$ with a very thin skin or overcoat of a harder material having a Youngs modulus of about $10^8$ Newtons/$m^2$. Although skins of 1 mil were effective, best results were obtained when the skin was less than 10 microns in thickness.

U.S. patent application Ser. No. 843,587, filed Feb. 28, 1992 in the name of McCabe, describes a toner comprising very small particles of pigmented thermoplastic resin having on their surfaces a coating of small particles which are applied to an aqueous dispersion in a uniform distribution and are strongly adhered to the toner particles. This application discloses extremely small particles of colloidal silica, aluminum oxide or a latex polymer or copolymer of a size less than 0.2 microns which, when properly adhering to the toner particles, can assist in the transfer of such particles.

U.S. patent application Ser. Nos. 843,664 and 843,666, filed Feb. 28, 1992 to Aslam et al, disclose examples of the transfer of toners prepared by the methods disclosed in the McCabe application, which toners have a mean particle diameter of 3.5 microns. The transfer is accomplished by a combination of heat and electrostatic field from a photoconductive surface to a conductive intermediate, for example, a metal sheet. The toner is then transferred to a receiving sheet utilizing heat and fused in the same step. Transfers as high or higher than 99% efficiency were obtained with this process to high quality receiving paper.

U.S. Pat. No. 5,084,735 and U.S. patent application Ser. Nos. 843,587; 843,664 and 843,666 are all incorporated by reference in this application.

SUMMARY OF THE INVENTION

It is an object of the invention to electrostatically transfer very small toner particles, that is, particles having a mean diameter less than 7 microns, from a primary image member to a receiving sheet.

This and other objects are accomplished by forming an electrostatic image on a primary image member and toning the electrostatic image with toner made up of small, dry toner particles having a mean particle diameter of less than 7 microns and transfer assisting particles strongly adhering to their surfaces, the transfer assisting particles having a mean diameter between about 0.01 microns and about 0.2 microns. The toner image is transferred from the primary image member to an intermediate receiving surface of an intermediate image member, the intermediate image member having a base having a Youngs modulus of $10^7$ Newtons/$m^2$ or less and a thin overcoat or skin which defines the intermediate receiving surface and has a Youngs modulus of $5\times10^7$ Newtons/$m^2$ or more, in the presence of an electric field urging the toner particles toward the intermediate image member. The toner image is then transferred from the intermediate image member to a receiving sheet in the presence of an electric field urging the toner particles toward the receiving sheet.

Preferably, the intermediate receiving surface has been formed or ground to unusual smoothness. For example, transfer efficiencies in excess of 95% of 3.5 micron toner from a photoconductive image member to a receiving sheet of ordinary paper are obtained with the intermediate receiving surface having a roughness average of 0.5 microns. The desired smoothness is related to the smallness of the particles. It is preferred that the roughness of the intermediate receiving surface be 20% of the mean particle diameter of the toner, or less.

Although this is a lower efficiency than the best transfer processes using heat, it is as high as conventional electrostatic transfer of larger 15 micron toner directly from a photoconductor to paper, and much higher than prior attempts to directly electrostatically transfer very small toner without heat.

Because of the advantages of an intermediate in color combining and the demand for small particles in quality color imaging, the invention is particularly usable in making multicolor images.

DISCLOSURE OF THE PREFERRED EMBODIMENT

Figure 1:
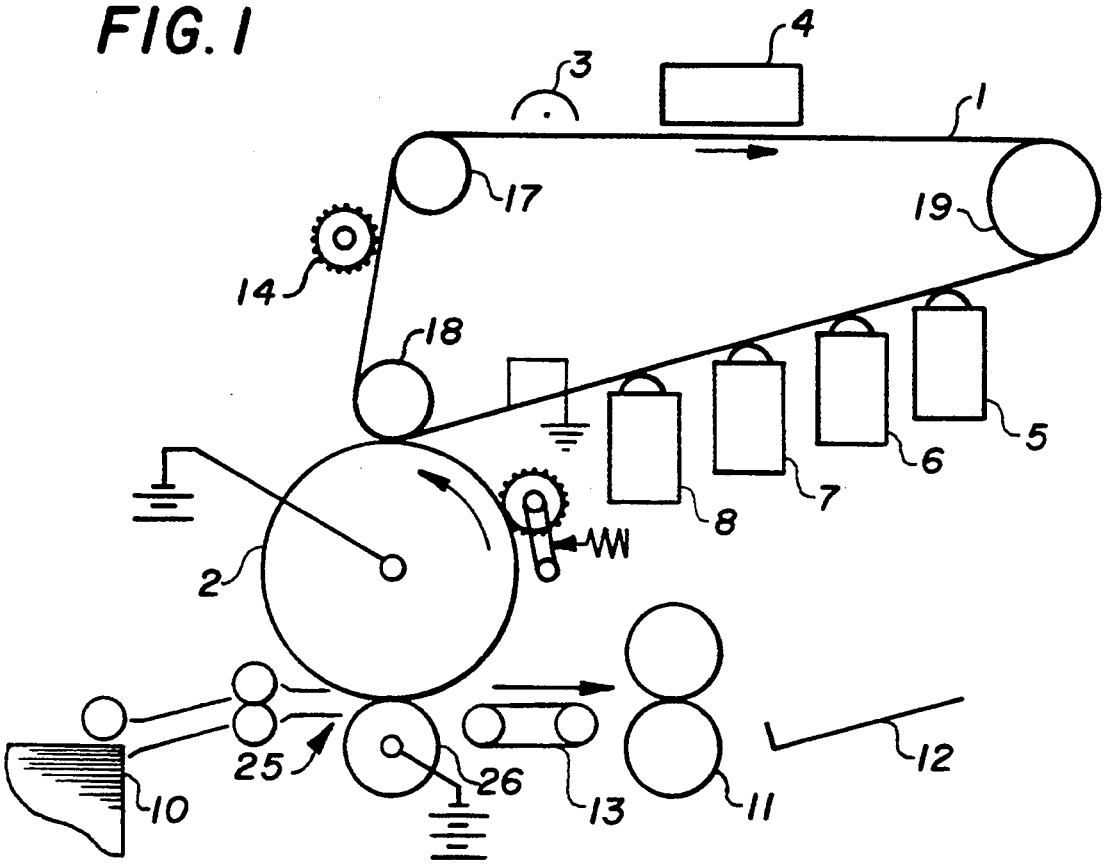
FIG. 1 is a side schematic of a color printer apparatus for practicing the invention.

FIG. 1 illustrates an apparatus for carrying out the invention. A primary image member, for example, a photoconductive web 1 is trained about rollers 17, 18 and 19, one of which is drivable to move image member 1 past a series of stations well known in the electrophotographic art. Primary image member 1 is uniformly charged at a charging station 3, imagewise exposed at an exposure station 4, for example, an LED printhead or laser electronic exposure station, to create an electrostatic image. The image is toned by one of toning stations 5, 6, 7 and 8 to create a toner image corresponding to the color of toner in the station used. The toner image is transferred from primary image member 1 to an intermediate image member, for example, intermediate transfer roller or drum 2 at a transfer station formed between roller 18, primary image member 1, and intermediate transfer drum 2. The primary image member 1 is cleaned at a cleaning station 14 and reused to form more toner images of different color utilizing toner stations 5, 6, 7 and 8. One or more additional images are transferred in registration with the first image to drum 2 to create a multicolor toner image on the surface of intermediate transfer drum 2. Although there are some mechanical advantages associated with the intermediate image member being a drum or roller, the invention can also be practiced if the intermediate image member is an endless web or a sheet or plate. Similarly, the primary image member can be a drum, sheet or plate as well as a web.

The multicolor image is transferred to a receiving sheet which has been fed from a supply 10 into transfer relation with transfer drum 2 at a transfer station 25. The receiving sheet is transported from transfer station 25 by transport mechanism 13 to a fuser 11 where the toner image is fixed by conventional means. The receiving sheet is then conveyed from the fuser 11 to an output tray 12. The receiving sheet can be a cut sheet, as illustrated, or a continuous sheet fed from a roll. Intermediate transfer facilitates the use of a roll supply in color imaging, because the receiving sheet does not have to be recirculated to combine the color images.

Each toner image is transferred from the primary image member 1 to the intermediate transfer drum 2 in response to an electric field applied between the core of drum 2 and a conductive electrode forming a part of primary image member 1. The multicolor toner image is transferred to the receiving sheet at transfer station 25 in response to an electric field created between a backing roller 26 and the transfer drum 2. Thus, transfer drum 2 helps establish both electric fields. As is known in the art, a polyurethane roller containing an appropriate amount of antistatic material to make it of at least intermediate conductivity, can be used for establishing both fields. Typically, the polyurethane is a relatively thick layer, for example, ¼ inch thick, which has been formed on an aluminum base. Typically, the electrode buried in primary image member 1 is grounded for convenience in cooperating with the other stations in forming the electrostatic and toner images. If the toner is a positively charged toner, an electrical bias applied to intermediate transfer drum 2 of typically −400 to −1,000 volts will effect substantial transfer of toner images to transfer drum 2. To then transfer the toner image onto a receiving sheet at transfer station 25, a bias, for example, of −3,000 volts, is supplied to backing roller 26 to again urge the positively charged toner to transfer to the receiving sheet. Schemes are also known in the art for changing the bias on drum 2 between the two transfer locations so that roller 26 need not be at such a high potential.

Unfortunately, as toners become smaller, transfer becomes more and more difficult. We believe this to be due to the fact that the electrostatic field to be unable to overcome nonelectrostatic forces between very small toner and the surfaces involved. Increasing the electric field risks electrical breakdown.

Figure 2:
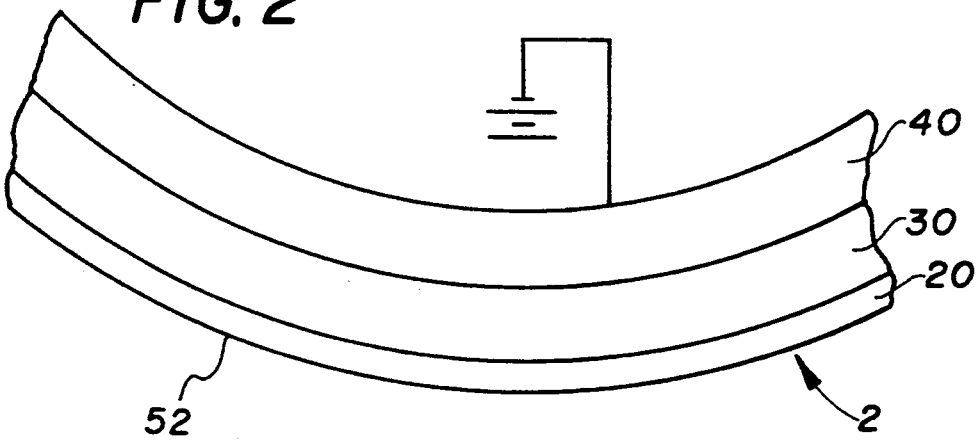
FIG. 2 is a cross-section of a portion of an intermediate transfer roller or drum useful in practicing the invention.

As disclosed in some of the examples in U.S. Pat. No. 5,084,735, a particular intermediate image member is useful in improving the transfer of small toner particles. Referring to FIG. 2, intermediate transfer drum 2 has a polyurethane base 30 and a thin skin 20 (not shown to scale) coated or otherwise formed on it. The polyurethane base has an aluminum core 40. The thin skin 20 defines an intermediate receiving surface 52 which receives the toner from the primary image member 1 and, in turn, passes it to the receiving sheet at transfer station 25.

According to this invention, the results obtained in the prior patent can be further improved upon, utilizing the teachings of that patent with the toners disclosed in the McCabe application (U.S. patent application Ser. No. 07/843,587, referred to above). Preferably, in addition to having a very thin skin of a relatively hard material on the relatively soft base material of the intermediate, the intermediate receiving surface 52 is made extremely smooth for use with extremely small particles. More specifically, it is preferable that the intermediate receiving surface 52 has a roughness average less than the mean diameter of the toner particles. For very highest efficiencies, a roughness average substantially less than the toner particle size is preferred. For example, a roughness average of 0.5 microns of intermediate receiving surface 52 provides superior results with 3.5 micron toner (less than 20% of the mean particle size). Although such smoothness will provide the best results, remarkable results have been achieved with a somewhat less smooth surface, as evidenced by the following example.

A cyan toner was prepared by forming core particles predominantly of a thermoplastic binder polymer sold as Piccotoner 1221® by Hercules Co. It was pigmented with a bridged aluminum phthalocyanine, and an ionic charge control agent was added. The core particles had a 3.5 micron average diameter and were made by the evaporative limited coalescence process disclosed in U.S. Pat. No. 4,833,060.

To a 200 g portion of the core toner particles in a blender was added 200 g of distilled water and 12 g of Nalcoag 1060® silica which contains 50% silica. The toner, water and silica were mixed for 20 minutes in a KitchenAid mixer after which the resulting paste was dried with a heated water jacket (120° F.) and heated air from a hair dryer. Mixing continued during drying down to about 10% moisture. Final drying was carried out in an oven for three days at 45° C. providing a final product that is three parts silica for 100 parts core toner. The toner had an average particle size of 3.5 microns and the silica had an average particle size of about 0.06 microns.

An electrostatic image was prepared on a primary image member having a commercial organic photoconductor. The electrostatic image was toned with the above toner using a rotating core magnetic brush to provide a toner image. The toner image was transferred to an intermediate transfer drum biased to 750 volts relative to a grounded conductive layer of the primary image member and a nip pressure of about 3 psi. The toner image was then transferred to a receiving sheet using a 3,000 volt bias on the backup roller with a nip pressure of about 20 psi.

The intermediate drum had a 0.2 inch polyurethane base on an aluminum core. The polyurethane base was overcoated with a 5 micron coating of a hard urethane resin sold under the tradename Permuthane by Permuthane, Inc., a division of ICI, Inc., and having a Young's modulus of $10^8$ Newtons per square meter and a volume resistivity of approximately $10^{12}$ ohm-cm. The surface of the coating, the intermediate transfer surface, was ground to a surface roughness of about 0.5 microns. The backup roller had a hardness of 90 Shore Å and a volume resistivity of about $2\times10^8$ ohm-cm.

Transfer efficiencies equal to or greater than 95% were achieved with a variety of high quality receiving sheets including Spectrum Bond paper, Laser Bond paper, Vintage Velvet Text paper, 6 point Kromekote paper and a specially prepared polyester coated paper used for thermal transfer. All transfers were accomplished at room temperature.

From the above it can be seen that very good transfer efficiencies are obtained with toner particles of a size not previously believed to be efficiently electrostatically transferrable. These transfer efficiencies, while not as high as thermally-assisted transfer, compare very favorably with transfer efficiencies in modem electrophotographic copiers. This invention provides the possibility of using very small toner particles in methods which do not use heat for transfer, thereby providing high resolution images of the type applicable to high quality color imaging.

The invention has been described in detail with particular reference to a presently preferred embodiment, but it will be understood that variations and modifications can be effected within the spirit and scope of the invention.

We claim:

1. A method of forming a dry toner image on a receiving sheet, which toner image is made up of small, dry toner particles, said method comprising:

forming an electrostatic image on a primary image member;

toning said electrostatic image with toner made up of small, dry toner particles having a mean particle diameter of less than 7 microns and transfer-assisting particles strongly adhering to their surfaces, said transfer-assisting particles having a mean diameter of between about 0.01 microns and about 0.2 microns;

transferring said toner image from said primary image member to an intermediate receiving surface of an intermediate image member, said intermediate receiving surface having a roughness average less than the mean particle diameter of said toner particles, said intermediate image member having a base having a Youngs modulus of $10^7$ Newtons/m$^2$ or less and a thin overcoat or skin which defines said intermediate receiving surface and has a Youngs modulus of $5\times10^7$ Newtons/m$^2$ or more, in the presence of an electric field urging said toner particles toward said intermediate image member; and transferring said toner image from said intermediate image member to a receiving sheet in the presence of an electric field urging said toner image toward said receiving sheet.

2. The method according to claim 1 wherein both said base and overcoat or skin of said intermediate image member are made of polyurethanes.

3. The method according to claim 1 wherein the intermediate receiving surface has a roughness average equal to 20% of the mean particle diameter of the toner particles or less.

4. The method according to claim 2 wherein the intermediate receiving surface has a roughness average equal to 20% of the mean particle diameter of the toner particles or less.

5. The method according to claim 1 wherein the intermediate receiving surface has a roughness average of 0.5 microns or less.

6. The method according to claim 2 wherein the intermediate receiving surface of the intermediate image member has a roughness average of 0.5 microns or less.

7. The method according to claim 1 wherein the overcoat or skin is made of a hard polyurethane having a Youngs modulus of about $10^8$ Newtons/m$^2$.

8. The method according to claim 1 wherein the mean size of the toner particles is less than 5 microns.

9. The method according to claim 1 wherein the transfer-assisting particles are colloidal silica aqueous dispersible particles adhering on the surface of the toner particles.

10. The method according to claim 9 wherein the transfer-assisting particles are between 0.5 to 5 weight percent of the toner particles.

11. The method according to claim 1 wherein the transfer-assisting particles have an average diameter between 0.02 microns and 0.08 microns.

12. The method according to claim 1 wherein the toner is prepared by the steps of mixing an aqueous dispersion of the transfer-assisting particles with the toner particles, agitating the resulting mixture to ensure uniform distribution and drying said toner particles.

* * * * *